United States Patent [19]

Komori et al.

[11] Patent Number: 4,884,613

[45] Date of Patent: Dec. 5, 1989

[54] SASH ASSEMBLY WITH BUILT-IN BLIND

[75] Inventors: Akihiro Komori, Takamatsu; Muneyoshi Hirano, Kurobe, both of Japan

[73] Assignee: Yoshida Kogyo K. K., Tokyo, Japan

[21] Appl. No.: 231,345

[22] Filed: Aug. 11, 1988

[30] Foreign Application Priority Data

Aug. 12, 1987 [JP] Japan ..... 62-124063

[51] Int. Cl.[4] ..... E06B 3/32

[52] U.S. Cl. ..... 160/107; 160/90; 49/380

[58] Field of Search ..... 160/107, 90, 381; 52/202; 49/380, 463, 64

[56] References Cited

U.S. PATENT DOCUMENTS

| | | | |
|---|---|---|---|
| 2,752,606 | 12/1955 | Persson | 160/107 X |
| 4,274,468 | 6/1981 | McPhail | 160/90 |
| 4,514,945 | 5/1985 | Menchetti et al. | 52/203 X |
| 4,567,701 | 2/1986 | Biggs et al. | 52/233 |

*Primary Examiner*—Blair M. Johnson

*Attorney, Agent, or Firm*—Hill, Van Santen, Steadman & Simpson

[57] ABSTRACT

A sash assembly with a built-in blind wherein, upon modification of the existing fixed sash window to such a sash assembly with a built-in blind, the existing window frame can be utilized as it is without having to dismantle it, and which has an extremely simple construction and whereby the existing fixed sash window can be modified to a fixed sash window with a built-in blind at a low cost.

This sash assembly with a built-in blind includes a sacrifice frame fitted in a glass panel fitting groove formed in the inner peripheral portion of an existing window frame and having a projecting member formed in the inner peripheral surface thereof; a window unit having a blind mounted in between two glass panels fixedly secured, respectively, on the indoor side and outdoor side and also comprising projecting members formed in the outer peripheral surface thereof, said projecting members being adapted to be connected with the projecting member of said sacrifice frame; and sealing materials filled in the joints formed between the fixed sash window frame and the peripheral stile and rail members of the window and which are located towards the inside and outside of the room.

5 Claims, 10 Drawing Sheets

SASH ASSEMBLY WITH BUILT-IN BLIND

BACKGROUND OF THE INVENTION

1. FIELD OF THE INVENTION

This invention relates to a sash assembly with a built-in blind, and more particularly to a sash assembly with a built-in blind of the type to be attached afterwards which can be fitted to the existing window frame as it is, upon effecting modification of the existing fixed sash window to a sash assembly with a built-in blind.

2. DESCRIPTION OF THE PRIOR ART

Sash assemblies with built-in blinds wherein glass panels are located on the indoor and outdoor sides, and a blind is located between them have excellent light shielding and sound-proof properties and give a good appearance from the design point of view. Therefore, various kinds of such sash assemblies have already been marketed, and also the applicant (assignee) of the present application has filed a Japanese Patent Application No. SHO-61-233800 for claiming a patent for an invention for modification of the existing sliding door or other type of door to a sash assembly with a built-in blind.

However, in the case of the sash assembly with a built-in blind of the type to be attached afterwards which is disclosed in the above-mentioned prior Japanese patent application, the glass panel fitting grooves formed in the inner peripheral parts of the stile and rail members in the existing sliding door or other type of door are used, and the arrangement is made such that the window unit is attached by fitting projecting members which project from the outer peripheral surface of the stile and rail members of the window unit with a built-in blind into the glass panel fitting grooves. Therefore, when the existing window sash is modified to a sash assembly with a built-in assembly, it is required to disassemble once the stile and rail members of the existing sliding door or other type of door and then fit the window unit in it to make reassembly.

Thus, even if it is desired to apply the above-mentioned assembly construction to the existing fixed sash window to modify it to a sash assembly with a built-in blind, since the window frame in the fixed sash window is fixed to the building wall in inseparable condition, unlike the case of the stile and rail members of sliding doors etc., it is difficult to modify the fixed sash window to a sash assembly with a built-in blind without removing the window sash from the building wall by some means and then disassembling it once and reassembling or replacing it with new one.

SUMMARY OF THE INVENTION

The present invention has been made in view of the abovementioned circumstances, and has for its aim to provide a sash assembly with a built-in blind wherein the above-mentioned points in issue in the prior art have been eliminated, and upon modification of the existing fixed sash window to a sash assembly with a built-in blind, the existing window frame can be utilized as it is, and which has an extremely simple construction and whereby the existing fixed sash window can be modified to a fixed sash window with a built-in blind at a low cost.

To achieve the above-mentioned aim, according to the first aspect of the present invention, there is provided a sash assembly with a built-in blind, including a sacrifice frame fitted in a glass panel fitting groove formed in the inner peripheral portion of the window frame of the existing fixed sash window and having a rail-shaped projection member formed in the inner peripheral surface thereof; a window unit having a blind located in between two glass panels mounted on the indoor and outdoor sides, respectively, and also comprising rectangular peripheral stile and rail members each having projecting members formed in the outer peripheral surface thereof, said projecting members being adapted to be connected with the projecting member of said sacrifice panel; and sealing materials filled in the joints formed between the existing fixed sash window frame and the peripheral stile and rail members of said window unit and which are located on the indoor and outdoor sides, respectively.

According to the second aspect of the present invention, there is provided a sash assembly with a built-in blind, characterized in that said projecting members formed in the outer peripheral surface of each of the peripheral stile and rail members in the window unit as set forth in the abovementioned first aspect comprise a pair of projecting members formed in parallel relationship and close to each other; and a connecting piece is inserted between the pair of projecting members of each of the stile and rail members at the both ends thereof.

Further, according to the third aspect of the present invention, there is provided a sash assembly with a built-in blind, characterized in that the sacrifice frame as set forth in the above-mentioned first aspect has a groove for receiving screws formed in the outer peripheral surface of the base plate and which is located opposite to the rail-shaped projecting member formed in the inner peripheral surface thereof.

Still further, according to the fourth aspect of the present invention, there is provided a sash assembly with a built-in blind, characterized in that the sacrifice frame as set forth in the above-mentioned first aspect has a pair of leg members which project from the outer peripheral surface of the base plate and whose opposite outside surfaces are located at a space interval that is equal to the width of the glass panel fitting groove, each of the leg members having an outwardly projected engaging portion formed integrally at the lower end thereof.

Further, according to the fifth aspect of the present invention, there is provided a sash assembly with a built-in blind, characterized in that the sealing material as set forth in the above-mentioned first aspect is of a wet construction which comprises longitudinally extending members made of polyurethane or polyethylene foam, and commercially available caulking materials filled on the outside thereof.

Still further, according to the six aspect of the present invention, there is provided a sash assembly with a built-in blind, characterized in that the sealing material as set forth in the above-mentioned first aspect is of a dry construction which comprises resilient packing materials which are inserted in and fixedly secured by the engaging portions formed along the projecting members formed in the outer peripheral surface of each of said stile and rail members.

The above-mentioned and other aims, features and advantages of the present invention will become apparent to those skilled in the art from the following description and accompanying drawings in which preferred embodiments based on the principle of the present invention are shown by way of examples, and also from the scope of claims thereof.

DETAILED DESCRIPTION OF PREFERRED EMBODIMENT

The present invention will now be described below in more details with reference to the accompanying drawings.

Figure 5:
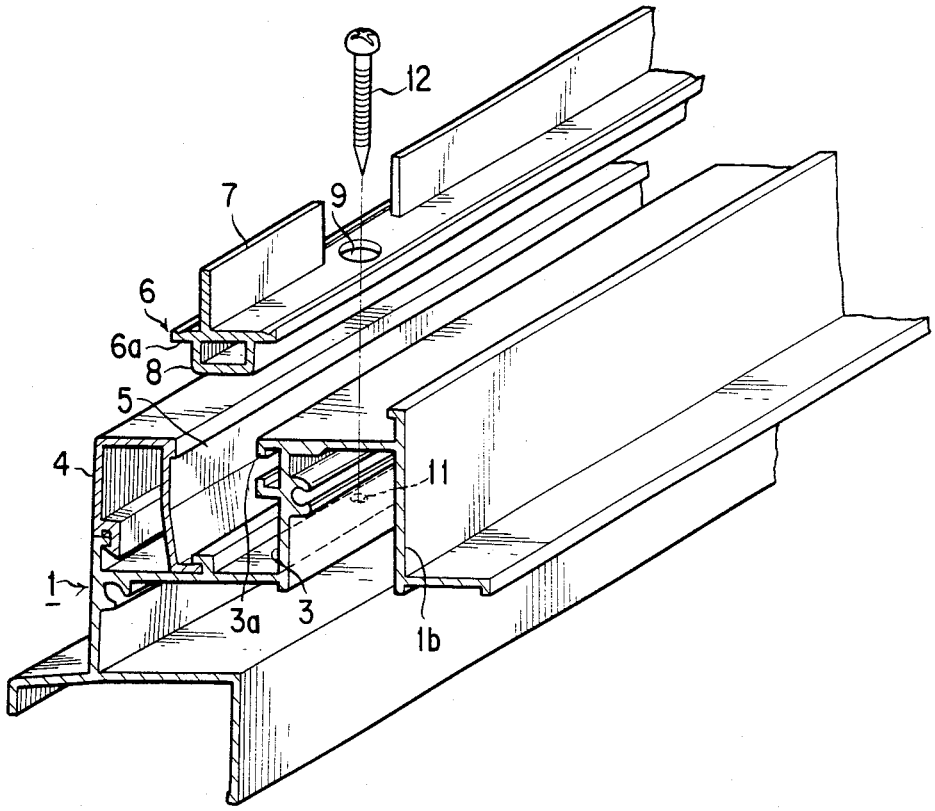
FIG. 5 is a fragmentary perspective view showing the operation of attaching a sacrifice frame to the existing window frame.

In FIGS. 1 to 5, reference numeral 1 denotes an existing window frame for a window W, 2 a window unit with a built-in blind fitted to inside of the window frame 1. In the central parts of the inner peripheral surfaces formed by upper and lower horizontal frames 1*a*, 1*b* and left and right vertical frames 1*c*, 1*c*, there are provided peripherally extending glass panel fitting grooves 5, each of which is formed by a stepped vertical wall 3 having an outwardly projected engaging portion 3*a*, and a batten 4 fitted from the outdoor side. In this glass panel fitting groove 5, a sacrifice frame 6 having such a sectional shape as shown in FIG. 5 is fitted in place of a fixed glass panel located before modification. In the case of this embodiment, the sacrifice frame 6 has an upstanding rail-shaped projecting member 7 which extends from the upper surface (or the inner peripheral surface) of a base plate 6*a* at right angles to the latter, the projecting member 7 being wider than the width of the above-mentioned glass panel fitting groove 5. The base plate 6 has, at the lower surface (or the outer peripheral surface) thereof, a concave groove 8 formed as an integral part thereof and which is narrower than the width of the glass panel fitting groove 5. After fitting in the above-mentioned glass panel fitting groove 5, the sacrifice frame 6 is fixedly secured to the window frame 1 by means of screws 12 each of which is inserted through a hole 9 formed in the base plate 6*a* and the bottom web of the groove portion 8 and is threadably engaged with a female screw-threaded hole 11 formed in one side of the window frame 1.

Figure 10:
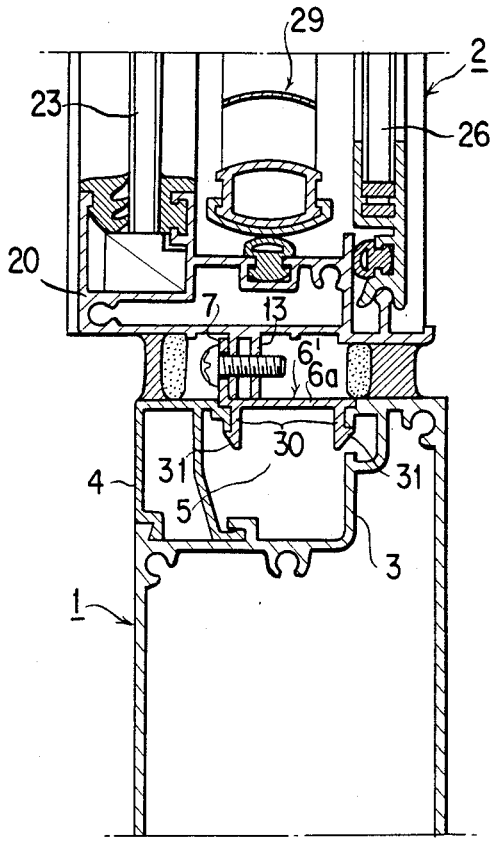
FIG. 10 is an enlarged, fragmentary longitudinal sectional view showing principal parts wherein the existing window frame is connected with a window unit having a sash assembly with a built-in blind by means of an alternative example of a sacrifice frame.

Further, as for the above-mentioned sacrifice frame 6, a sacrifice frame 6′ as shown in FIG. 10 may be used, which has a pair of leg members 30, 30 which project from the lower surface of the base plate 6*a* and whose opposite outside surfaces are located at a space interval which is equal to the width of the glass panel fitting groove 5, each of the leg members 30, 30 having an outwardly projected engaging portion 31 formed integrally at the lower end thereof. The above-mentioned sacrifice frame 6′ may be secured to the inside of the glass panel fitting groove 5 by using means for press-fitting the former into the latter in snap-fit manner.

Figure 6:
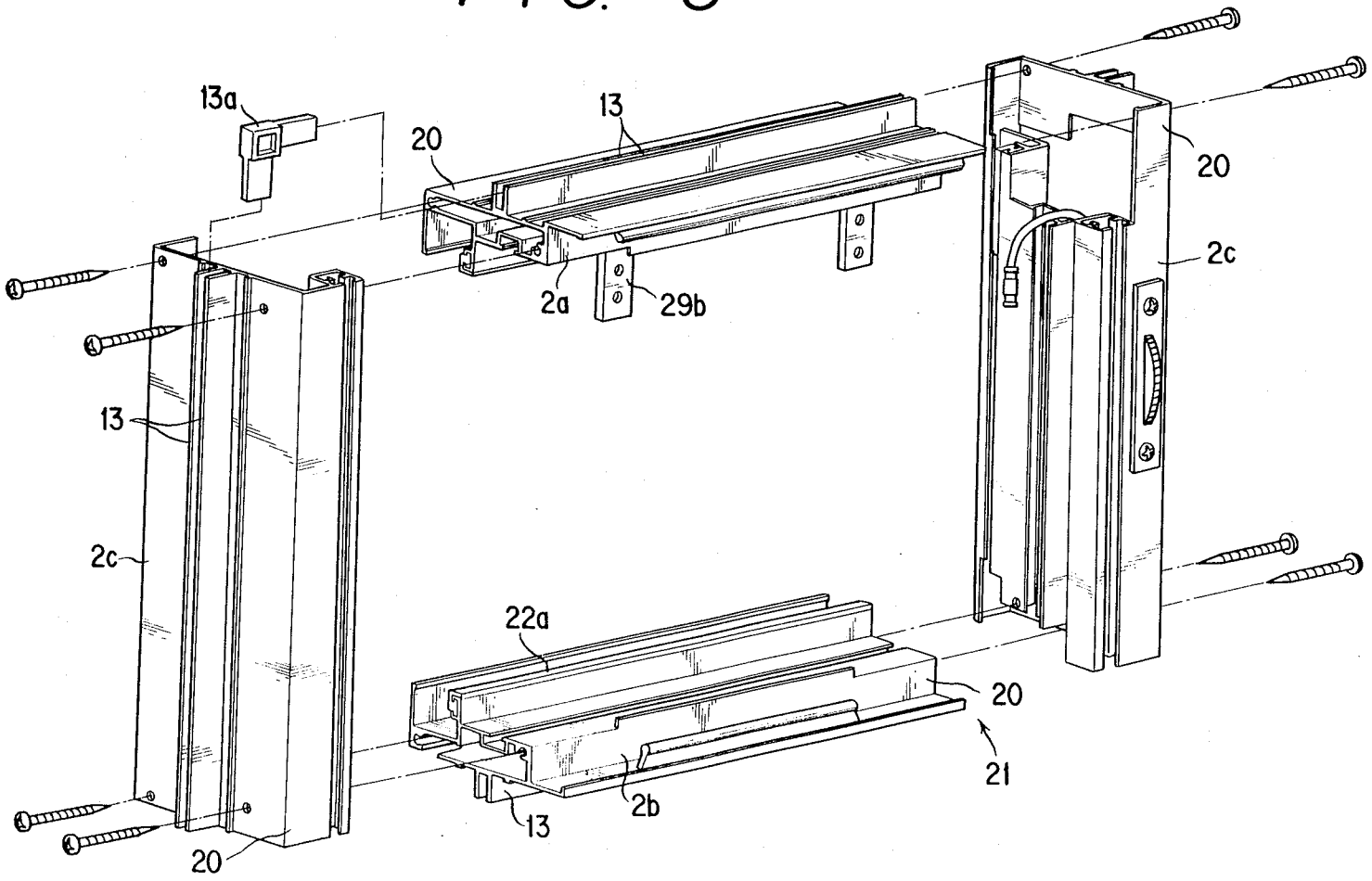
FIG. 6 is an exploded perspective view showing a construction for connecting rectangular peripheral stiles and rails forming a window unit for a sash assembly with a built-in blind according to the present invention.

In the window unit 2 with a built-in blind, as shown in FIG. 6 in exploded perspective view, stile and rail members 20 which form upper and lower rails 2*a* and 2*b*, and left and right stiles 2*c*, 2*c* are connected with one another by means of a well known connecting means such as tap screws adapted to be screwed into screw pockets to thereby form a rectangular stile and rail assembly 21 of the type to be attached afterwards. A glass panel 23 is fixedly secured within the groove 22 of the inner peripheral surface of each of the stile and rail members 20 on the outdoor side by means of a bead 22*a* to be attached previously and a bead 22*b* to be attached afterwards. Further, a glass panel 26 held in a frame member 25 is attached between opposed upper and lower rails 24*a* and 24*b* on the indoor side, so that it may swing or pivot together with the frame member 25 about the lower rail 24*b*, the upper end of the glass panel 26 and the frame member 25 adapted to be swung towards the indoor side being detachably secured by means of tightening screws 28 to the stile and rail members 20. A blind 29 is located in the space 27 hermetically sealed by both the glass panels 23 and 26 the blind 29 has slats 29*a* which are suspended from and secured by a support member 29*b* secured at an upper end so that they may be moved up and down and tilted.

As mentioned above, the principal part of the window unit 2 does not differ substantially from the sash assembly with a built-in blind of the type to be attached afterwards disclosed in the aforementioned Japanese Patent Application No. SHO 61-233800 which is a prior patent application made by the applicant (assignee) of the present invention. In the case of the present invention, however, the outer peripheral surface of each of the stile and rail members 20 in the above-mentioned window unit 2 has projecting members 13, 13 formed integrally thereon in parallel relationship and at nearly the same height as that of the corresponding projecting member 7 formed on the sacrifice frame 6, the stile and rail members 20 being connected with one another by inserting corner connecting pieces 13*a* in between the projecting members 13, 13 at the both ends of each of the stile and rail members 20.

Figure 1:
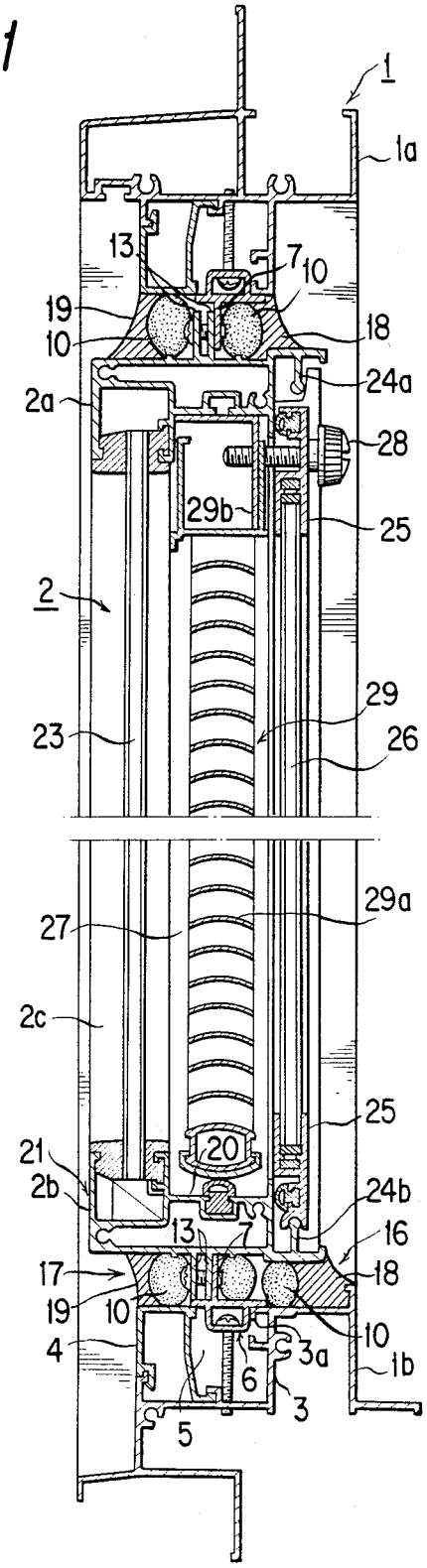
FIG. 1 is a longitudinal sectional view showing one embodiment of a sash assembly with a built-in blind according to the present invention fitted to the existing fixed sash window frame.
Figure 2:
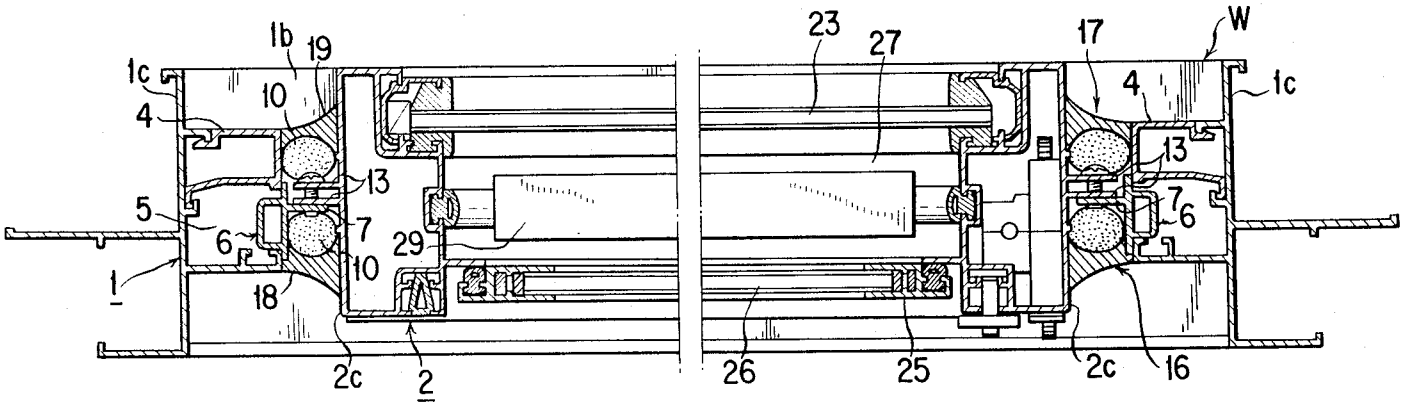
FIG. 2 is a horizontal sectional view of the embodiment shown in FIG. 1.
Figure 3:
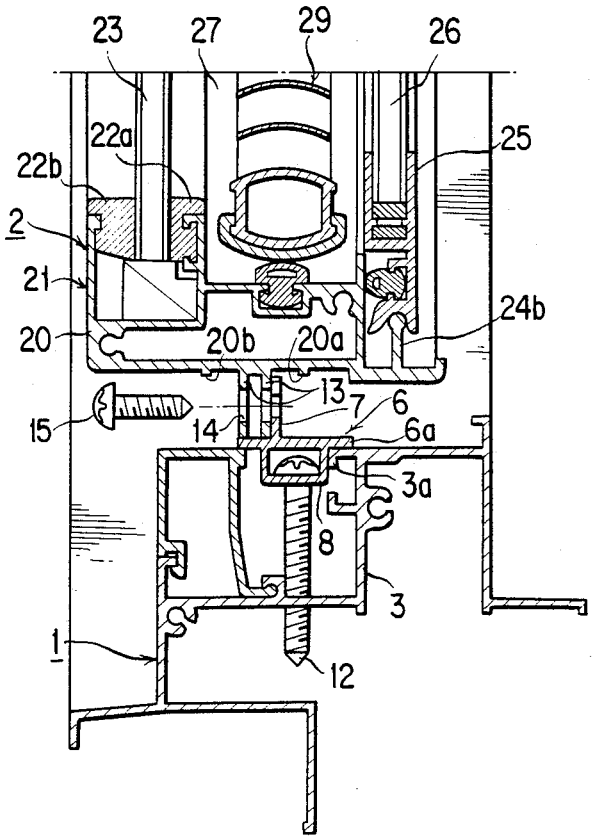
FIGS. 3 and 4 are an enlarged longitudinal sectional view and an enlarged horizontal sectional view, respectively, showing principal parts of the embodiment shown in FIGS. 1 and 2.
Figure 4:
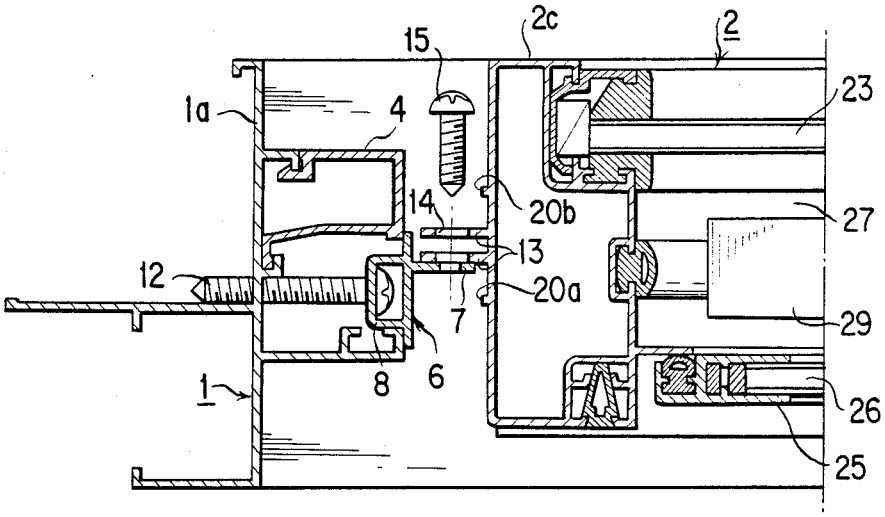

The sash assembly with a built-in blind is comprised of combination of the window frame 1 and the window unit 2 having the above-mentioned construction. Upon connection of the window frame 1 and the window unit 2, the sacrifice frame 6 is first fitted in the glass panel fitting groove 5 in the window frame 1 and fixedly secured by means of screws 12. After that, screw insertion holes 14 are formed previously at a predetermined interval through each of the projecting members 13 which project from the outer peripheral surface of each of the stile and rail members 20 in the window unit 2. Thereafter, the window unit 2 is fitted inside the window frame 1 from either the indoor side or outdoor side, so that the projecting members 13, 13 of the window unit 2 and the projecting member 7 on the side of the window frame 1 may overlap each other as shown in FIG. 3. After that, screws 15 are inserted through the holes in the members 13 and 7 from the outside of the room and are tightened up to fixedly secure both the members 13 and 7. By so doing, upon effecting modification, without having to disassemble the existing window frame 1 and reassemble it, the window unit 2 with a built-in blind can be readily fitted in the window frame 1 by using the sacrifice frame 6 as a connecting medium. After that, water proofing is made by filling sealing materials 18, 19 into joints 16, 17, respectively, formed between the above-mentioned window frame 1 and the stile and rail members 20 located on the indoor side and outdoor side to complete the assembly of the window frame 1 and the window unit 2.

Figure 7:
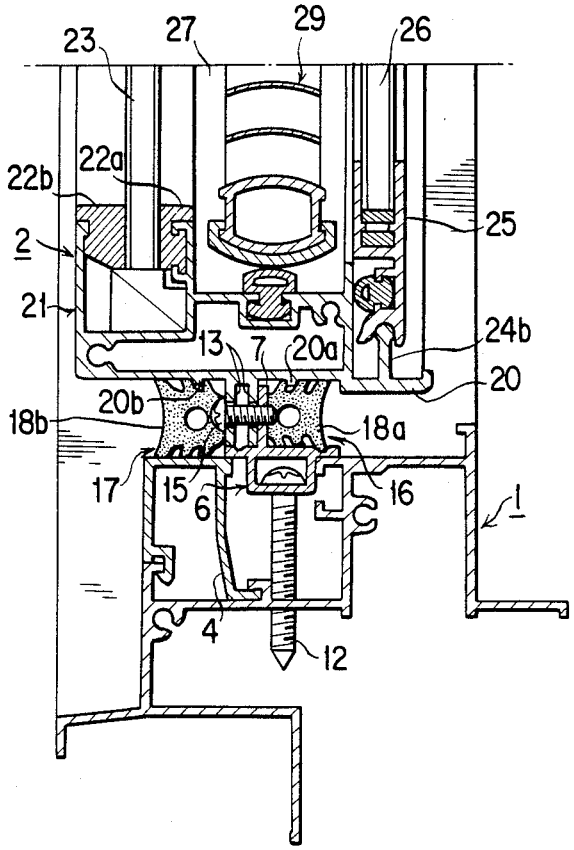
FIG. 7 is an enlarged, longitudinal sectional view of principal showing an example of sealing material filled in the joints formed in the connecting portion of an existing window frame and a window unit, having a sash assembly with a built-in blind according to the present invention.

In this case, as for the sealing materials 18, 19 to be filled in the joints 16, 17, there are sealing materials of wet and dry types. In the above-mentioned embodiment, there is illustrated a wet type construction in which a longitudinally extending member made of polyurethane or polyethylene foam serving as a back-up member 10 is inserted in the joints 16 and 17, and a commercially available caulking material is filled outside the back-up member 10. Whilst, a dry construction as shown in FIG. 7 in which resilient packing materials **18*a* and 18*b* are filled and secured fixedly by the engaging portions 20*a* and 20*b* formed in the outer peripheral surfaces of the stile and rail members 20**.

Further, in the above-mentioned embodiment, the sacrifice frame 6 serving to connect the window frame 1 and the window unit 2 has a projecting member 7 on the front side (in the inner periphery) of the base plate 6 which contacts with the inner peripheral surface of the window frame 1 and which serves as a boundary, and the groove 8 adapted to receive a screw on the rear side (in the outer peripheral surface) of the base plate 6. Therefore, the face measure of the joints 16 and 17 after the window unit 2 is connected to the window frame 1 can be reduced to enable a presentable modification to be achieved, and the reduction in the area of the glass panel on the whole surface of the fixed window panel can be minimized. Further, the sash assembly with a built-in blind is advantageous in that the window unit 2 can be fitted readily from either the outdoor side or indoor side.

Figure 8:
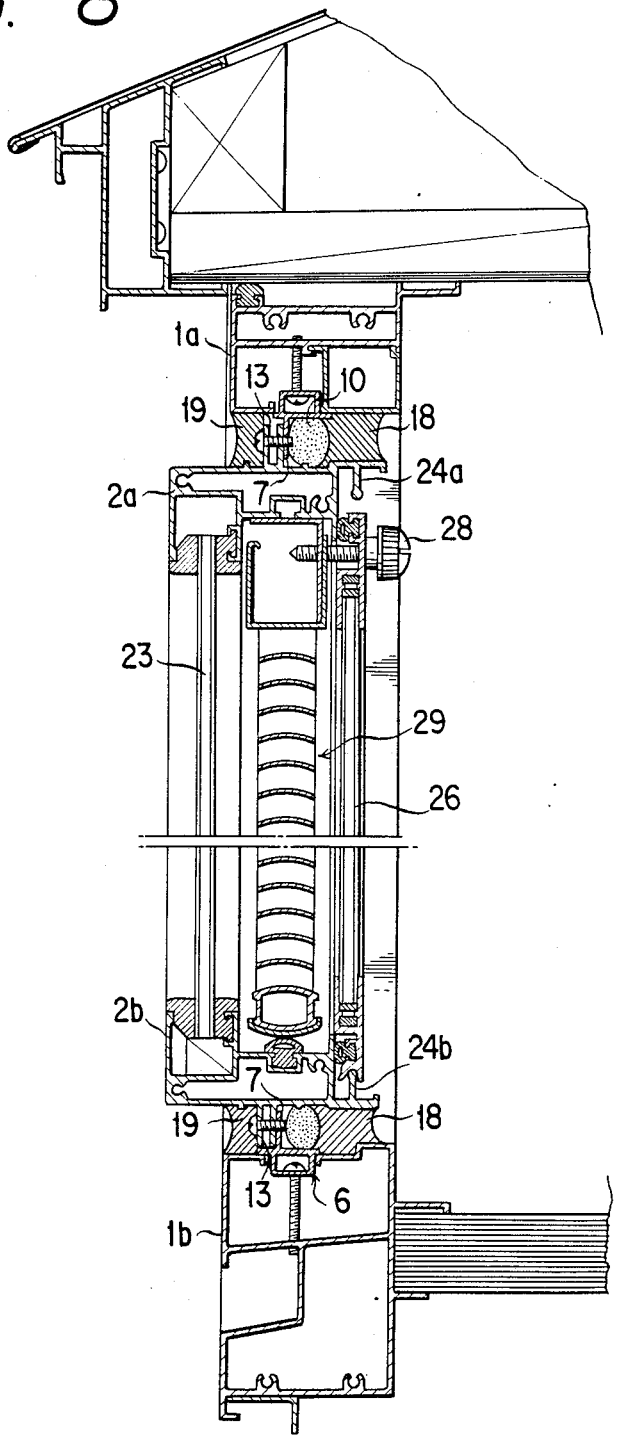
FIGS. 8 and 9 are a longitudinal sectional view and a horizontal sectional view, respectively, showing one embodiment wherein a sash assembly with a built-in blind according to the present invention is applied to the existing triangular bay-window.
Figure 9:
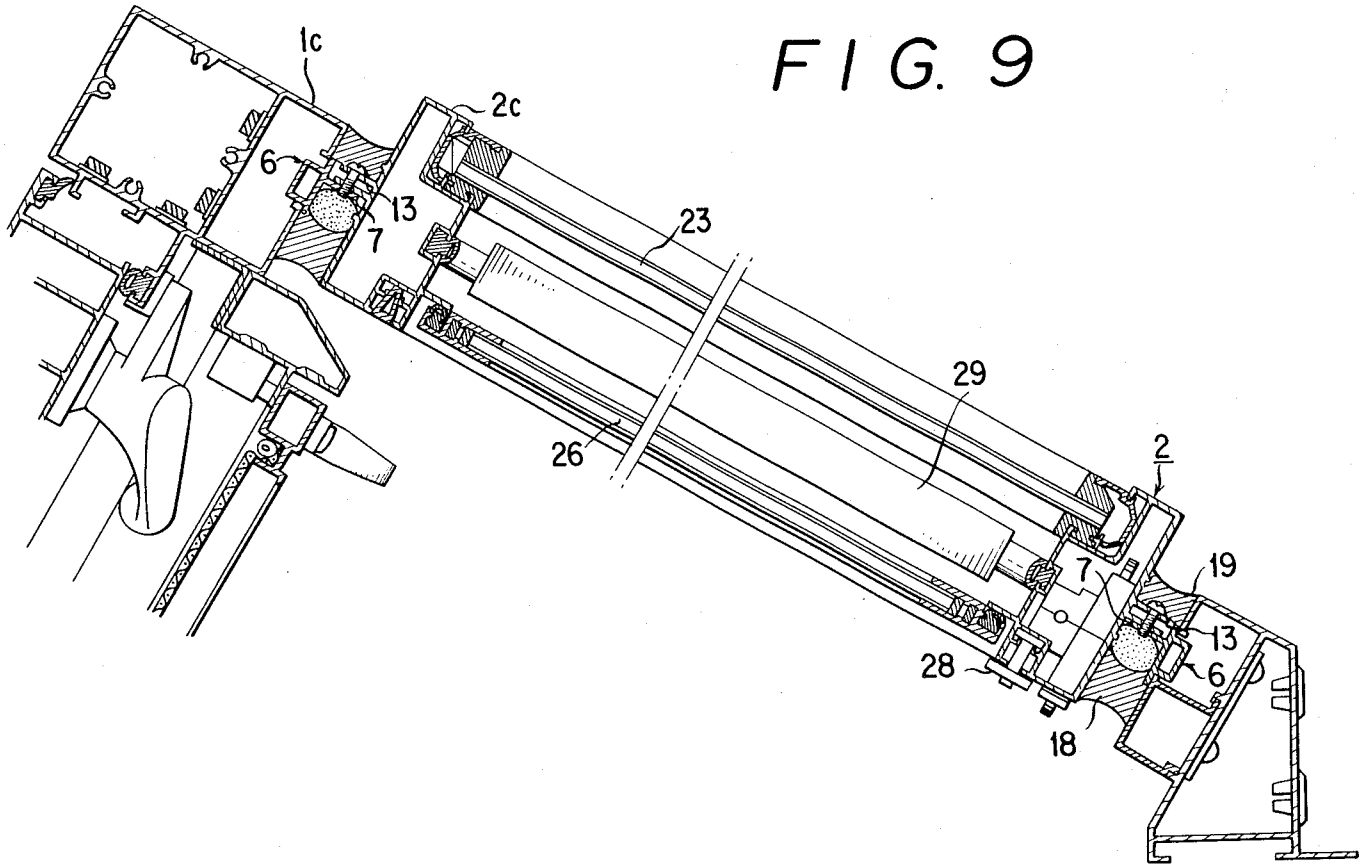

Still further, FIGS. 8 and 9 show an embodiment of the present invention applied to the fixed sash portion of a triangular bay-window W. In this embodiment, the sectional shape of upper and lower horizontal frames **1*a*, 1*b* and left and right vertical frames 1*c*,1*c* which form the window frame 1 is different from that in the case of the first embodiment, but the position and shape of the glass panel fitting groove 5** remain basically unchanged. Therefore, modification of the existing sash construction to the sash assembly with a built-in blind can be made utilizing the construction of the aforementioned embodiment as it is.

It is to be understood that the foregoing description is merely illustrative of preferred embodiments of the invention, and that the scope of the invention is not to be limited thereto, but is to be determined by the scope of the appended claims.

What is claimed is:

1. A sash assembly with a built-in blind, comprising:

a sacrifice frame fitted in a glass panel fitting groove formed in the inner periphery of the window frame of the existing fixed sash window and having a rail-shaped projecting member formed in the inner peripheral surface thereof;

a window unit having a blind located in between two glass panels mounted, respectively, on the indoor side and outdoor side and also comprising rectangular peripheral stile and rail members each having projecting members formed in the outer peripheral surface thereof, said projecting members being adapted to be connected with the projecting member of said sacrifice panel, said projecting member formed in the outer peripheral surface of each of the peripheral stile and rail members in the window unit comprising a pair of projecting members formed in parallel relationship and close to each other, a connecting piece being inserted between the pair of projecting members of each of the stile and rail members at the two ends thereof; and sealing materials filled in the joints formed between the existing fixed sash window frame and the peripheral stile and rail members of said window unit and located on the indoor side and outdoor side, respectively.

2. A sash assembly with a built-in blind as claimed in claim 1, characterized in that said sacrifice frame has a groove for receiving screws formed in the outer peripheral surface of a base plate which is located opposite to the rail-shaped projecting member formed in the inner peripheral surface thereof.

3. A sash assembly with a built-in blind, comprising:

a sacrifice frame fitted in a glass panel fitting groove member formed in the inner periphery of the window frame of the existing fixed sash window and having a rail-shaped projecting member formed in the inner peripheral surface thereof, said sacrifice frame has a pair of leg members which project from the outer peripheral surface of a base plate and whose opposite outside surfaces are located at a space interval that is equal to the width of the glass panel fitting groove, each of the leg members having an outwardly projected engaging portion formed integrally at the lower end thereof;

a window unit having a blind located in between two glass panels mounted, respectively, on the indoor side and the outdoor side and also comprising rectangular peripheral stile and rail members each having projecting members each having outer peripheral surface thereof, said projecting members being adapted to be connected with the projecting member of said sacrifice panel; and sealing materials filled in the joints formed between the existing fixed sash window frame and the peripheral stile and rail members of said window unit and located on the indoor side and outdoor side, respectively.

4. A sash assembly with a built-in blind as claimed in claim 1, characterized in that said sealing material is of a wet construction which comprises longitudinally extending members made of polyurethane or polyethylene foam, and commercially available caulking materials filled on the outside thereof.

5. A sash assembly with a built-in blind as claimed in claim 1, characterized in that said sealing material is of a dry construction which comprises resilient packing materials which are inserted in and fixedly secured by the engaging portions formed along the projecting members formed in the outer peripheral surface of each of said stile and rail members.

* * * * *